US007348893B2

(12) United States Patent
Huang et al.

(10) Patent No.: US 7,348,893 B2
(45) Date of Patent: Mar. 25, 2008

(54) BOREHOLE COMMUNICATION AND MEASUREMENT SYSTEM

(75) Inventors: Songming Huang, Hardwick (GB); Franck Bruno Jean Monmont, Caldecote (GB); Robert W. Tennent, Lower Cambourne (GB); Randolph J. Sheffield, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 328 days.

(21) Appl. No.: 11/077,936

(22) Filed: Mar. 11, 2005

(65) Prior Publication Data

US 2006/0131014 A1 Jun. 22, 2006

Related U.S. Application Data

(60) Provisional application No. 60/638,632, filed on Dec. 22, 2004.

(51) Int. Cl.
*G01V 3/00* (2006.01)

(52) U.S. Cl. ..... 340/854.3; 340/885.5; 367/81

(58) Field of Classification Search ..... 340/854.3, 340/855.4, 855.5, 856.3; 367/81, 83
See application file for complete search history.

(56) References Cited

U.S. PATENT DOCUMENTS 3,659,259 A 4/1972 Chaney, Jr. et al.
3,742,443 A 6/1973 Foster et al.
3,747,059 A 7/1973 Garcia
3,789,355 A 1/1974 Patton
3,906,434 A 9/1975 Lamel et al.
3,964,556 A 6/1976 Gearhart et al.
4,513,403 A 4/1985 Troy
4,642,800 A 2/1987 Umeda
5,073,877 A 12/1991 Jeter
5,253,099 A 10/1993 Heidemann
5,273,112 A 12/1993 Halliburton
5,283,768 A 2/1994 Rorden
5,586,084 A * 12/1996 Barron et al. ..... 367/85
5,730,219 A * 3/1998 Tubel et al. ..... 166/250.1
5,839,508 A 11/1998 Tubel et al.
5,924,499 A 7/1999 Birchak et al.
5,995,449 A * 11/1999 Green et al. ..... 367/83

(Continued)

FOREIGN PATENT DOCUMENTS

EP 0685628 A1 12/1995

(Continued)

OTHER PUBLICATIONS

Dawson, M., and M. Smith, New Setting Technique for Gravel Pack Packers Increases Operational Safety and Reduces Costs, SPE #80451, SPE Asia Pacific Oil & Gas Conference, Jakarta, Indonesia, Apr. 15-17, 2003, pp. 1-12.

(Continued)

*Primary Examiner*—Timothy Edwards, Jr.
(74) *Attorney, Agent, or Firm*—Trop, Pruner & Hu, P.C.; Daryl Wright; Bryan P. Galloway

(57) ABSTRACT

A technique that is usable with a well includes using at least one downhole sensor to establish telemetry within the well. The sensor(s) are used as a permanent sensing device.

51 Claims, 7 Drawing Sheets

U.S. PATENT DOCUMENTS

| | | | | |
|---|---|---|---|---|
| 6,172,614 | B1 | 1/2001 | Robison et al. | |
| 6,173,772 | B1 | 1/2001 | Vaynshteyn | |
| 6,182,764 | B1 * | 2/2001 | Vaynshteyn | 166/373 |
| 6,320,820 | B1 | 11/2001 | Gardner et al. | |
| 6,414,905 | B1 | 7/2002 | Owens | |
| 6,439,306 | B1 | 8/2002 | Patel | |
| 6,442,105 | B1 | 8/2002 | Tubel et al. | |
| 6,462,672 | B1 | 10/2002 | Besson | |
| 6,469,637 | B1 * | 10/2002 | Seyler et al. | 340/856.3 |
| 6,550,538 | B1 | 4/2003 | Hermann et al. | |
| 6,741,185 | B2 | 5/2004 | Shi et al. | |
| 6,766,854 | B2 | 7/2004 | Ciglenec et al. | |
| 2003/0006906 | A1 | 1/2003 | Gardner | |
| 2003/0015319 | A1 | 1/2003 | Green et al. | |
| 2003/0016164 | A1 * | 1/2003 | Finke et al. | 342/83 |
| 2003/0026167 | A1 | 2/2003 | Hahn et al. | |
| 2003/0086336 | A1 | 5/2003 | Dubinsky | |
| 2003/0116969 | A1 | 6/2003 | Skinner et al. | |

FOREIGN PATENT DOCUMENTS

| | | | |
|---|---|---|---|
| EP | 0919696 | A2 | 6/1999 |
| EP | 1302624 | A1 | 4/2003 |
| GB | 2343537 | A | 5/2000 |
| GB | 2348029 | A | 9/2000 |
| GB | 2351423 | A | 12/2000 |
| GB | 2397078 | A | 7/2004 |
| GB | 2399921 | A | 9/2004 |
| GB | 2405725 | A | 3/2005 |
| GB | 2407597 | A | 5/2005 |
| WO | 9609561 | A1 | 3/1996 |
| WO | 0227139 | A1 | 4/2002 |
| WO | 03067029 | A1 | 8/2003 |
| WO | WO2004/085796 | A1 | 10/2004 |
| WO | WO2005/024177 | A1 | 3/2005 |

OTHER PUBLICATIONS

Ishikawa, H., and H. Kobayashi, "Selection diversity with decision feedback equalizer", Proceedings of IEEE Vehicular Technology Conference, vol. 2, 1994, pp. 962-966.

Lee, Y., and C. Cox, "MAP Selection-Diversity DFE for Indoor Wireless Data Communications", IEEE Journal on Selected Areas in Communications, vol. 16, Oct. 1998, pp. 1376-1384.

IRIS Pulse Operated Borehole Tools, Schlumberger Commercial Brochure.

* cited by examiner

BOREHOLE COMMUNICATION AND MEASUREMENT SYSTEM

This application claims the benefit of U.S. Provisional Application 60/638,632 filed on Dec. 22, 2004.

BACKGROUND

The invention generally relates to a borehole communication and measurement system.

An intervention typically is performed in a subterranean or subsea well for such purposes as repairing, installing or replacing a downhole tool; actuating a downhole tool; measuring a downhole temperature or pressure; etc. The intervention typically includes the deployment of a delivery mechanism (coiled tubing, a wireline, a slickline, etc.) into the well. However, performing an intervention in a completed well may generally consume a significant amount of time and may entail certain inherent risks. Therefore, completion services that do not require intervention (called "interventionless" completion services) have become increasingly important for time and cost savings in offshore oilfield operations.

In a typical interventionless completion service, wireless signaling is used for purposes of communicating a command (for a downhole tool) from the surface of the well to a downhole receiver. More specifically, at the surface of the well, a command-encoded stimulus is produced, and this stimulus propagates downhole from the surface to a downhole receiver that decodes the command from the stimulus. The downhole receiver relays the command to the downhole tool that acts on the command to perform some desired action. Ideally, interventionless signaling should be very reliable; should consume as short a time as possible; should be applicable whether or not the well is filled with liquid up to the surface; and should be safe to the surrounding formation(s). However, conventional interventionless signaling may not satisfy all of these criteria.

For example, one type of conventional interventionless signaling involves applying a series of pressure level changes to a fluid at the surface of the well. These pressure level changes, in turn, form a command-encoded stimulus that propagates downhole to a downhole receiver. As a more specific example, an air gun may be fired in certain sequences to produce pressure changes that propagate downhole and represent a command for a downhole tool. A potential difficulty with the air gun technique is that in applications in which the well may not be filled with liquid that extends to the surface of the well, the air gun may need to produce large pressure amplitude changes. However, large pressure amplitude changes may place the formation at risk for fracturing or fluid invasion damage. Furthermore, the air gun technique may require significant knowledge of the channel properties and precise positions of echoes in order to avoid erroneous detection and/or interpretation by the downhole receiver.

Thus, there is a continuing need for a system and/or technique to address one or more of the problems that are stated above, as well as possibly address one or more problems that are not set forth above.

SUMMARY

In an embodiment of the invention, a technique that is usable with a well includes using at least one downhole sensor to establish telemetry within the well. The sensor(s) are used as a permanent sensing device.

In an embodiment of the invention, a technique that is usable with a well includes receiving a code sequence that is indicative of information (a command, for example) to be communicated downhole. The technique includes modulating the code sequence to remove a portion of spectral energy (of the code sequence) that is located near zero frequency to create a signal. The technique includes generating a stimulus in fluid of the well in response to the signal to communicate the information downhole.

In another embodiment of the invention, a downhole receiver that is usable with a well includes a flow signal detector that is adapted to decode a flow signal downhole to generate a first code sequence. The downhole receiver also includes a pressure signal detector that is adapted to decode a pressure signal downhole to generate a second code sequence. A combiner of the downhole receiver selectively combines the first code sequence and the second code sequence to generate a third code sequence that indicates information (a command for a downhole tool, for example) that is communicated downhole from the surface of the well.

In yet another embodiment of the invention, a system that is usable with a well includes an uplink modulator and a downlink modulator. The uplink modulator is located downhole in the subterranean well and is adapted to modulate a carrier stimulus to generate a second stimulus that is transmitted uphole and is indicative of a downhole measurement. The downlink module is adapted to decode a flow signal that is communicated from the surface of the well and a pressure signal that is communicated from the surface of the well. The downlink module is adapted to selectively combine the decoded flow and pressure signals to provide a command for a downhole tool.

Advantages and other features of the invention will become apparent from the following description, drawing and claims.

DETAILED DESCRIPTION

Figure 1:
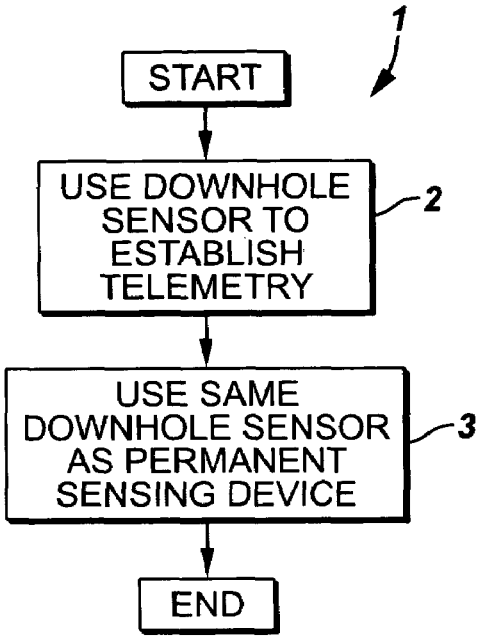
FIG. 1 is a flow diagram depicting potential uses of a downhole sensor according to an embodiment of the invention.

Referring to FIG. 1, an embodiment of a technique 1 in accordance with the invention includes using (block 2) at least one downhole sensor to establish telemetry within a well. Thus, for example, the sensor(s) may be located downhole in the well and sense, for example, fluid pressure changes or flow rate changes for purposes of detecting a command-encoded stimuli that is transmitted from the surface of the well. This same downhole sensor(s) may also be used as a permanent sensing device within the well, as depicted in block 3. Thus, not only may the sensor(s) be used for purposes of receiving commands, the sensor(s) may also be used for monitoring a downhole pressure, flow rate, etc., depending on the particular embodiment of the invention.

Figure 2:
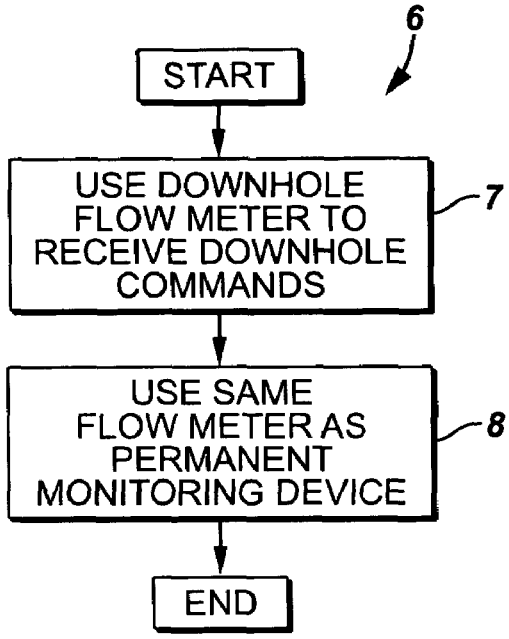
FIG. 2 is a flow diagram depicting a technique to use a flow meter as both a receiver for downhole commands and as a permanent monitoring device.

Referring to FIG. 2, as a more specific example, an embodiment of a technique 6 in accordance with the invention includes using a downhole flow meter to receive commands downhole in the well, as depicted in block 7. This same flow meter is also used (block 8) as a permanent monitoring device in the well. Thus, the flow meter may also be used to, for example, monitor a production flow downhole.

The above-described sensor/flow meter may be used in a borehole communication and telemetry system in which command-encoded fluid pressure pulses are communicated downhole and phase modulation of a pressure wave is used for purposes of communicating downhole measurements uphole.

As a more specific example, in accordance with some embodiments of the invention, the command that is detected by the sensor may be generated at the surface of the well and may be ultimately intended for a downhole tool for purposes of causing the tool to perform some downhole function. The command-encoded stimulus that conveys the command downhole may be generated, in some embodiments of the invention, by applying (at the surface of the well) relatively small binary-coded pressure magnitude or pressure slope changes to fluid in the well. These relatively small pressure magnitude/slope changes (for example, pressure changes that are individually no more than approximately 14.5 to 29 pounds per square inch (psi), in some embodiments of the invention) are within a range that is considered safe for the formation(s) of the well.

As further described below, in some embodiments of the invention, the downhole receiver detects and decodes the command-encoded stimulus by measuring a downhole flow rate and/or pressure changes that are attributable to the above-described surface pressure variations. For a borehole that has a column of gas near the surface of the well, the detection of the flow rate has the advantage of shortening the signaling time.

As also described below, the stimulus that is communicated downhole is generated in a manner that minimizes the effects of downhole pressure drift and that of echoes caused by signaling are minimized, thereby enabling reliable surface-to-downhole communication, regardless of the knowledge of channel properties or the precise locations of potential echoes.

In the context of this application, the "fluid" through which the command-encoded stimulus propagates does not necessarily mean a homogenous layer, in that the fluid may be a liquid layer, a gas layer, a mixture of well fluid and gas layers, separate gas and liquid layers, etc.

For purposes of simplifying the following description, the wireless transmission of a command from the surface to a downhole receiver is described herein. However, it is noted that information other than a command may be wirelessly transmitted from the surface to the downhole receiver, in other embodiments of the invention.

Figure 3:
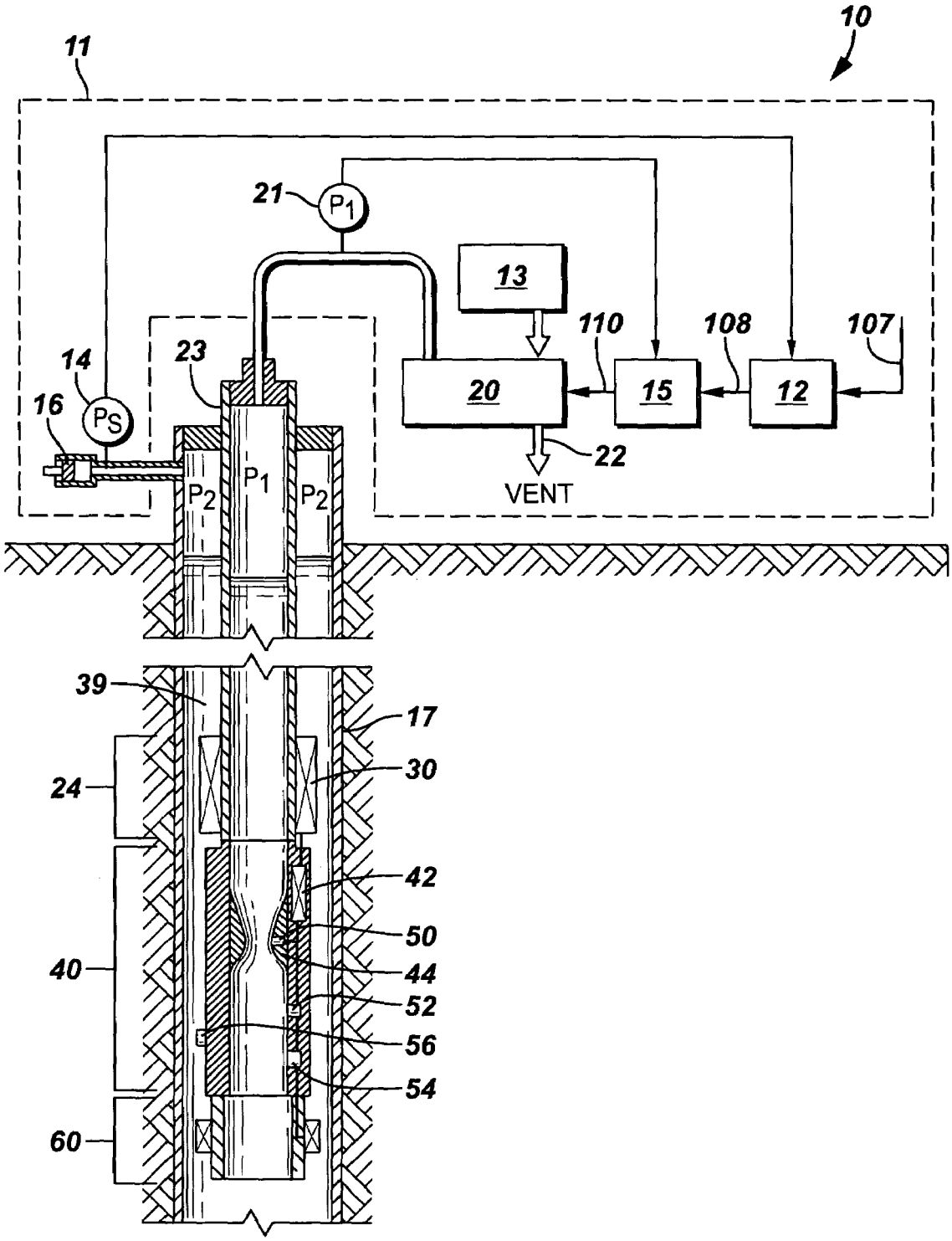
FIG. 3 is a schematic diagram of an integrated borehole communication and measurement system according to an embodiment of the invention.

Referring to FIG. 3, as a more specific example, an embodiment of an integrated borehole communication and measurement system 10 is constructed to wirelessly communicate commands downhole to downhole tools (such as a downhole tool 60, for example), perform downhole measurements (production flow rates, pressures, etc.) and wirelessly communicate these measurements uphole. Turning first to the communication of commands downhole, in accordance with some embodiments of the invention, the systems 10 includes surface signaling equipment 11 (located at the surface of a well) that receives a code sequence 107 that is indicative of a command for a downhole tool 60. As examples, if the downhole tool 60 is a packer (for purposes of example only), the command may be a "set packer" command; if the downhole tool 60 is a valve (as another example), the command may be a "close valve" command; etc.

The surface signaling equipment 11, in general, converts the code sequence 107 into a digital pressure control signal 108 and uses the digital pressure control signal 108 (as described below) to control the generation of a command-encoded fluid stimulus that propagates downhole to a receiver of a downlink module 40, a component of the tubing string 23. The downlink module 40, in turn, detects the stimulus, decodes the command and communicates the command to an actuator of the downhole tool 60.

For purposes of simplifying the following discussion, unless otherwise stated, it is assumed that the command-encoded stimulus propagates downhole through fluid (a liquid layer, a gas layer, a mixture of well fluid and gas layers, separate gas and liquid layers, etc.) that is contained inside a central passageway of a tubing string 23 that extends downhole inside a casing string 17. However, alternatively, in other embodiments of the invention, the stimulus may propagate downhole along other telemetry paths, such as an annulus 39 that is defined between the outer surface of the tubing string 23 and the inner surface of the casing string 17.

Additionally, although FIG. 3 depicts a single wellbore, it is understood the communication techniques that are disclosed herein may likewise apply to a lateral wellbore and multi-lateral well systems in general. Furthermore, although a subterranean well is depicted in FIG. 3, the systems and techniques that are disclosed herein may also apply to subsea wells.

The surface signaling equipment 11 includes a command encoder/digital receiver module 12 that 1.) performs a transmitter function by controlling the generation of stimuli for purposes of transmitting commands downhole (also called "downlink communication"); and 2.) performs a receiver function by detecting information-encoded stimuli that are transmitted from downhole devices to the surface (also called "uplink communication") and decoding the information from the stimuli. The receiver function of the module 12 is described further below.

Regarding the transmitter function that is performed by the module 12, the module 12 receives the code sequence 107, which is a sequence of digital data (i.e., a binary sequence of ones and/or zeros) that represents a command for the downhole tool 60, in some embodiments of the invention. The module 12, as further described below, may supplement the code sequence 107, as well as possibly modulate the supplemented code sequence for purposes of enhancing the communication of the command downhole. The processing/conversion of the code sequence 107 by the module 12 produces the digital pressure control signal 108.

The digital pressure control signal 108 is also a binary sequence of bits. The surface signaling system 11 responds one bit at a time to the digital pressure control signal 108, by manipulating the fluid pressure at the tubing head/wellhead to generally indicate the logical state of each bit. For example, the surface signaling system 11 may control the magnitude of the fluid pressure at the tubing/well head so that the pressure has a first magnitude for a logical bit state of zero and a second different magnitude (a higher magnitude, for example) for a logical bit state of one. Alternatively, the surface signaling system 11 may control the gradient of the fluid pressure at the tubing/well head so that the pressure has a positive rate of change for a certain logical bit state and a negative rate of change for the other logical bit state.

A new digital pressure control signal 108 is generated in response to each command to be communicated downhole and may be viewed as being associated with a given number of uniform time slots (one for each bit of the signal 108) so that during each time slot, the surface signaling system 11 controls the tubing/well head fluid pressure to indicate the state of a different bit of the signal 108.

As a more specific example, in some embodiments of the invention, the surface signaling system 11 includes an air/gas pressure control mechanism 20 for purposes of controlling the fluid pressure at the tubing/well head. In some embodiments of the invention, the pressure control mechanism 20 responds to the digital pressure control signal 108 to selectively vent pressure (called "$p_1$" and sensed by a pressure sensor 21) at the tubing/well head of the tubing string 23 for purposes of generating a desired pressure magnitude or pressure gradient. In the absence of the venting, pressure otherwise builds up at the tubing/well head due to an air/gas supply 13 (air/gas bottles, for example) that is in communication with the tubing/well head. If the well and the tubing string 23 are filled or nearly filled with liquid, a liquid pump instead of the air/gas supply 13 may be used, and the tubing/well head pressure control may be controlled by pumping liquid into or bleeding liquid out of the tubing string 23.

As described further below, in some embodiments of the invention, the pressure control mechanism 20 is not directly controlled by the digital pressure control signal 108. Instead, a feedback control circuit 15 (of the surface signaling system 11) receives the digital pressure control signal 108 and adjusts the signal (to produce a compensated pressure control signal 110) that the pressure control mechanism 20 uses to control the venting. More particularly, in some embodiments of the invention, the feedback control circuit 15 generates the compensated pressure control signal 110 by comparing the $p_1$ pressure (sensed by the pressure sensor 21) to a predetermined pressure threshold, or set point, in a feedback loop to ensure the $p_1$ pressure has the proper pressure magnitude/pressure gradient for the particular bit being currently communicated.

Figure 6:
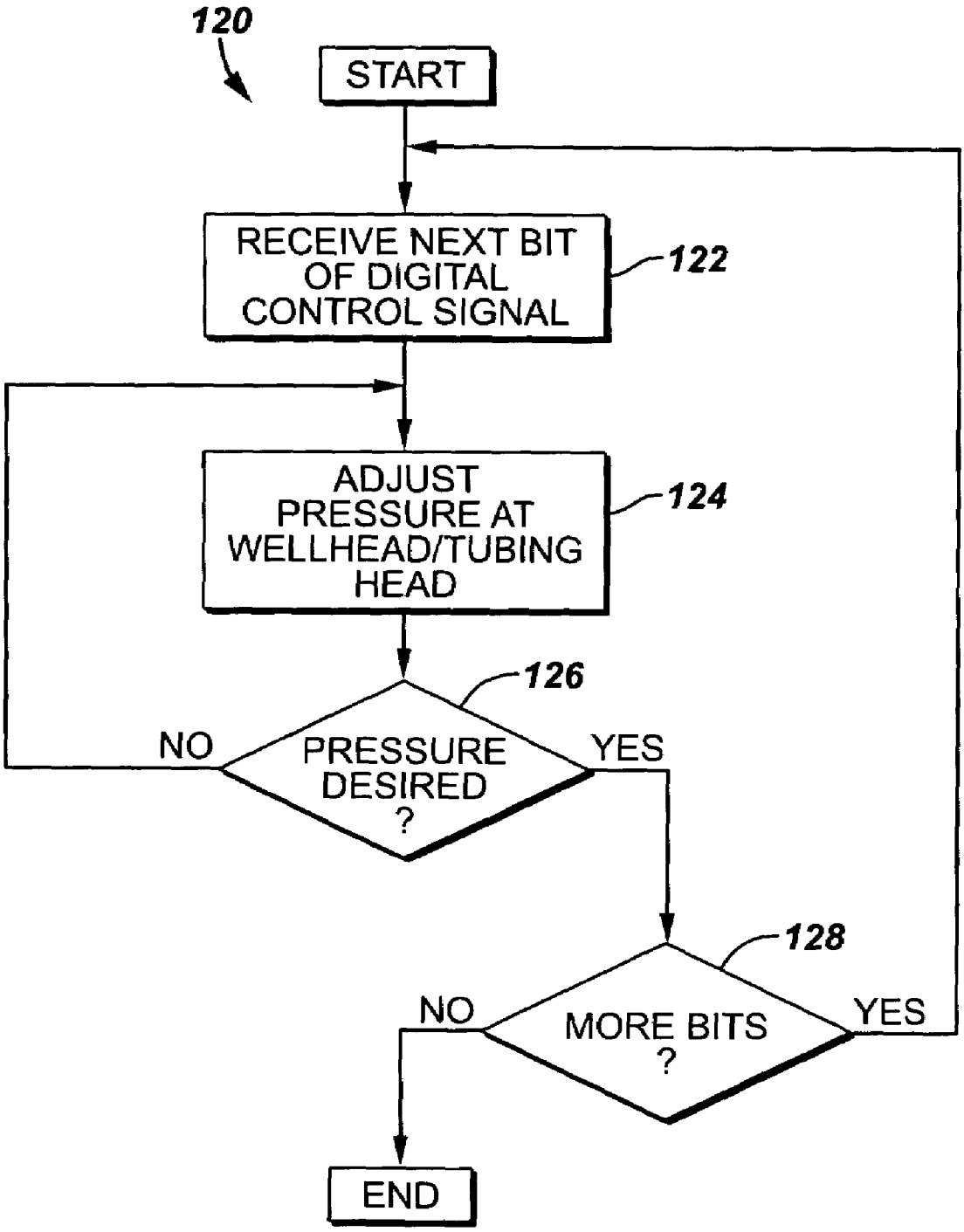
FIG. 6 is a flow diagram depicting a technique to control the generation of a fluid pressure stimulus in response to the digital pressure control signal according to an embodiment of the invention.

Thus, referring to FIG. 6, in accordance with an embodiment of the invention, a technique 120 may be used for purposes of responding to the compensated pressure control signal 110 to communicate a command-encoded stimulus downhole. Pursuant to the technique 120, the next bit of the digital pressure control signal 110 is received (block 122) and then, the pressure at the wellhead/tubing head is adjusted, as depicted in block 124. The pressure at the wellhead/tubing head is then measured, and if the pressure is determined (diamond 126) to not be equal to a predetermined pressure-set point, then control returns to block 124. Otherwise, the pressure is as desired and control transfers to diamond 128 in which the technique 120 determines whether there are more bits of the digital pressure control signal 108. If so, control returns to block 122.

Referring back to FIG. 3, the downlink module 40 is located in the vicinity of the downhole tool 60. More specifically, in some embodiments of the invention, the module 40 detects a liquid flow rate inside the tubing string 23 and also detects a fluid pressure inside the tubing string 23. From the resultant detected pressure and flow signals, the module 40 decodes a command for downhole tool 60 and communicates this command to the tool 60 so that an actuator (not shown) of the tool 60 may actuate the tool to perform the command.

As also depicted in FIG. 3, in some embodiments of the invention, the borehole communication system 10 also includes an uplink modulator module 24, a part of the tubing string 23 that includes a resonator 30 that performs modulation (phase modulation, for example) of a carrier stimulus that is communicated from the surface of the well for purposes of generating a modulated wave. This modulated wave propagates to the surface of the well for purposes of indicating a downhole measurement (a measurement by a sensor, for example). The carrier stimulus may be generated by a piston 16 that is located at the surface of the well and is in communication with the annulus 39, for example. The operation of the uplink modulator module 24 and resonator 30 may establish a Helmholtz resonator, as further described in U.S. patent application Ser. No. 11/017,631 entitled, "BOREHOLE TELEMETRY SYSTEM," filed on Dec. 20, 2004, having Songming Huang, Franck Monmont, Robert Tennent, Matthew Hackworth and Craig Johnson as inventors, and which is hereby incorporated herein by reference.

Turning now to more specific details of the borehole communication system 10, in some embodiments of the invention, the command encoder/digital receiver module 12, as set forth above, receives the binary input code sequence 107 (in the form of zeros and ones) that indicates a command (for example) to be communicated downhole. The module 12 may add a precursor code sequence, such as a Barker code sequence (as an example), to the beginning of the received input code sequence 107. This Barker code sequence, which may be 7, 11 or 13 bits (as examples), constitutes synchronization code that helps the downhole module 40 synchronize with the incoming code stream and also helps to train a diversity equalizer (described further below) inside the module 40.

In addition to the precursor code, the module 12 may also add an error correction code sequence after the code sequence 107. The error correction code may be used by the module 40 to detect transmission errors, as well as possibly correct minor transmission errors.

Figure 5:
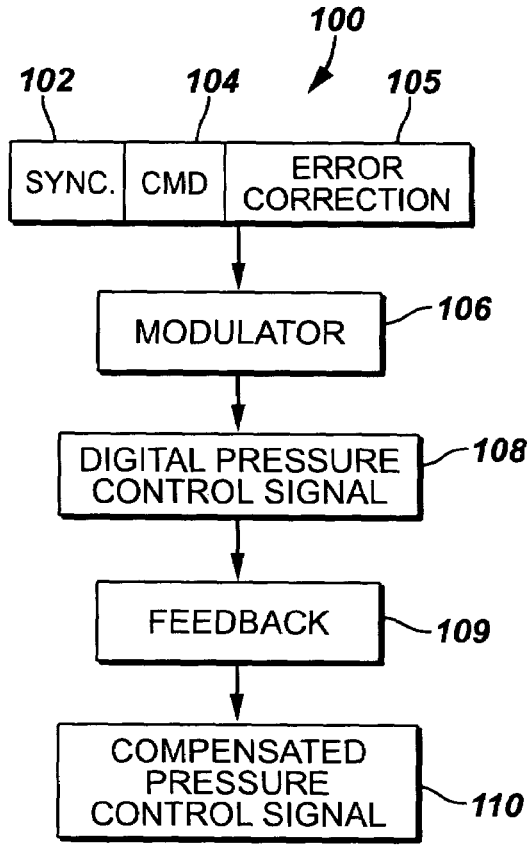
FIG. 5 is a block diagram depicting the generation of a digital pressure control signal that controls the generation of a stimuli that propagates downhole from the surface of the well according to an embodiment of the invention.

Thus, referring to FIG. 5 in conjunction with FIG. 3, in some embodiments of the invention, the module 12 combines the above-described code sequences to generate a code sequence 100 that includes a precursor synchronization code field 102 (contain Barker precursor code, for example); a command code field 104 (containing the code sequence 107 that was received by the module 12) that follows the field 102; and an error correction code field 105 (that contains error correction code generated from at least the code sequence 107, for example).

If the gas supply for pressure signaling is sufficient, the module 12 may apply secondary modulation, such as a zero-DC modulation, to the code sequence 100 to reduce the signal energy around zero frequency. A Manchester code, for instance, can be generated after such modulation. The advantage of the zero-DC encoding is to make the removal of DC drift by the downhole receiver (of the module 40) an easier task. When signaling with rising and falling pressure gradients, zero-DC modulation becomes more important. This is because, with such modulation, the maximum duration at each binary level is limited to no more than two bits, and this helps to limit the pressure level applied to the tubing head. For instance, if a long string of binary ones is to be transmitted downhole, without zero-DC modulation, the pressure would need to continuously increase (i.e., to create a rising slope) for a long period, thus leading to a pressure level that may be unacceptably high.

Figure 4:
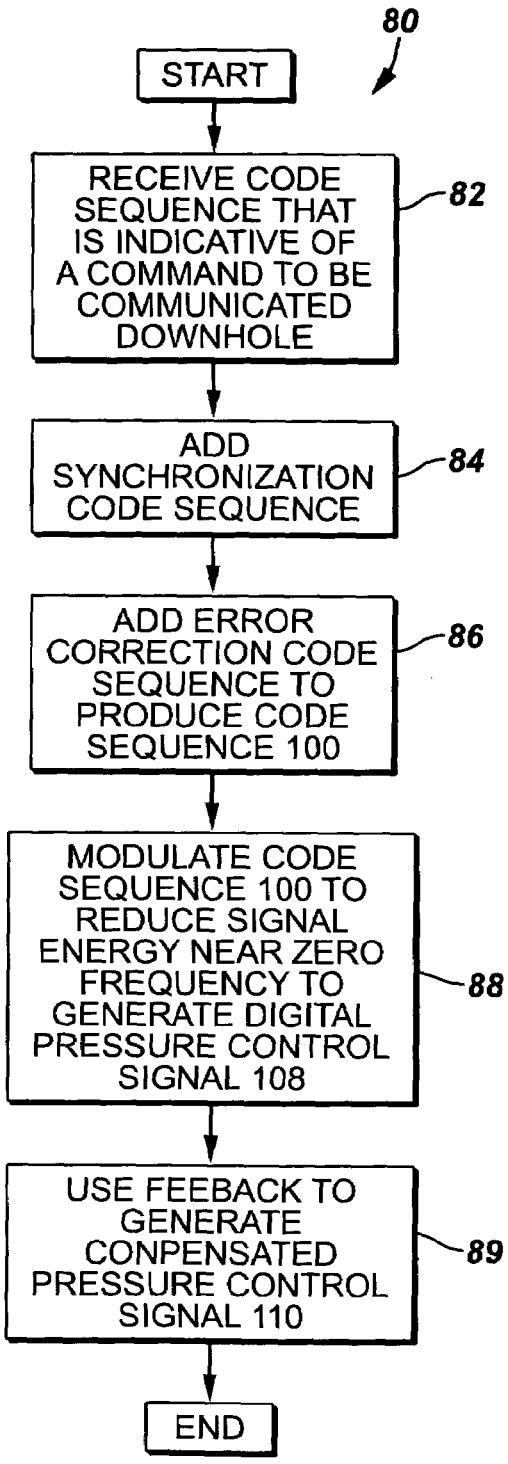
FIG. 4 is a flow diagram depicting a technique to generate a code sequence to be used in signaling a downhole tool according to an embodiment of the invention.

Therefore, referring to FIG. 4 in conjunction with FIG. 3, a technique 80 in accordance with the invention includes receiving a code sequence 107 that is indicative of a command (for example) to be communicated downhole, as depicted in block 82. Next, a synchronization code sequence (block 84) and an error correction code sequence (block 86) are added before and after the sequence, respectively, to produce the code sequence 100. In some embodiments of the invention, the technique 80 includes modulating (block 88) the code sequence 100 to reduce the signal energy near zero frequency and produce the digital pressure control signal 108. Pressure feedback from the well may then be used in conjunction with the digital pressure control signal 108 to generate the compensated pressure control signal 110, as depicted in block 89.

Referring back to FIG. 5, thus, in some embodiments of the invention, the command encoder/digital receiver module 12 includes a modulator 106 that performs modulation of the code sequence 100 to generate the digital pressure control signal 108. Feedback (block 109) is applied to the digital pressure control signal 108 to produce the compensated digital pressure control signal 110, as described above in connection with FIG. 4.

The hydraulic system that is depicted in FIG. 3 is equivalent to a U-tube. Initially, the hydraulic system is at equilibrium with the pressure at the tubing head equals that at the top of the annulus, i.e. $p_1=p_2=p_0$ (see FIG. 3), where "$p_2$" is the pressure inside the annulus 39 (FIG. 3) at the surface and can be atmospheric. Assuming that the law of ideal gas holds in this case, $$p_0V_0=n_0RT, \qquad \text{Equation 1}$$

where "$V_0$" represents the initial gas/air volume inside the tubing, "$n_0$" represents the initial mole number of the gas/air, "R" represents the gas constant and "T" represents the absolute temperature. When more gas is charged into the tubing head from the supply, Eq. 1 may be rewritten as follows:

$$p_1V_1=\left(n_0+\int_0^t q_m(t)\,dt\right)RT, \qquad \text{Equation 2}$$

where "$q_m(t)$" represents the instantaneous molar flow rate. As a result of the gas charge, the pressure at the tubing head increases. When the $p_1$ pressure is greater than the $p_2$ pressure, the column of liquid inside the tubing moves down, and the column of liquid in the annulus moves in an upward direction. Provided that $p_2$ pressure is atmospheric ($p_2=p_0$) and that, except during a short interval at the beginning, the movement velocity is constant, i.e. with zero acceleration, then the pressure increase may be expressed approximately as follows:

$$p_1-p_2=\rho gh, \text{ or } p_1=p_0+\rho gh, \qquad \text{Equation 3}$$

where "ρ" represents the liquid density, "g" represents the gravitational acceleration and "h" represents the height difference between the gas/liquid interfaces inside and outside the tubing. The movement of the liquid interface results in an increased gas volume inside the tubing, as described below:

$$V_1=V_0+\frac{h}{2}S, \qquad \text{Equation 4}$$

where "S" represents the inner cross-sectional area of the tubing. Substituting Eq. 3 and 4 into Eq. 2 yields the following relationship:

$$\frac{S}{2}\rho gh^2+\left(p_0\frac{S}{2}+\rho gV_0\right)h=RT\int_0^t q_m(t)\,dt, \qquad \text{Equation 5}$$

In the case of a constant gas charging rate, i.e. $q_m(t)=KQ$, then $$\int_0^t q_m(t)\,dt=KQt, \qquad \text{Equation 6}$$

where "K" represents a mass to molar conversion constant, "Q" represents the constant mass flow rate of the gas inflow and "t" represents the charging time. Equation 5 may be rewritten as follows:

$$\frac{S}{2}\rho gh^2+\left(p_0\frac{S}{2}+\rho gV_0\right)h=RTKQt, \qquad \text{Equation 7}$$

Equation 7 may be solved for the height difference, given the gas inflow rate, Q, and time, t. With the h height difference value, the pressure change inside the tubing, $p_1-p_0$, may be calculated from Eq. 3. A volumetric flow rate (called "$q_L$") of the liquid inside the tubing, which is seen by a downhole flow sensor, may be calculated with the following equation:

$$q_L = \frac{dV_1}{dt} = \frac{S}{2}\frac{dh}{dt}, \quad \text{Equation 8}$$

According to Eq. 3, the $q_L$ volumetric flow rate may also be expressed as the derivative of the pressure change as set forth below:

$$q_L = \frac{S}{2\rho g}\frac{dp_1}{dt}, \quad \text{Equation 9}$$

If the assumption is made that the tubing wall is very rigid, the liquid phase is almost incompressible and, for slow pressure variations, the pressure drop due to acceleration and friction is small, then the downhole pressure approximately equals approximately the tubing head pressure and the downhole flow rate follows approximately Eq. 9.

Figure 7:
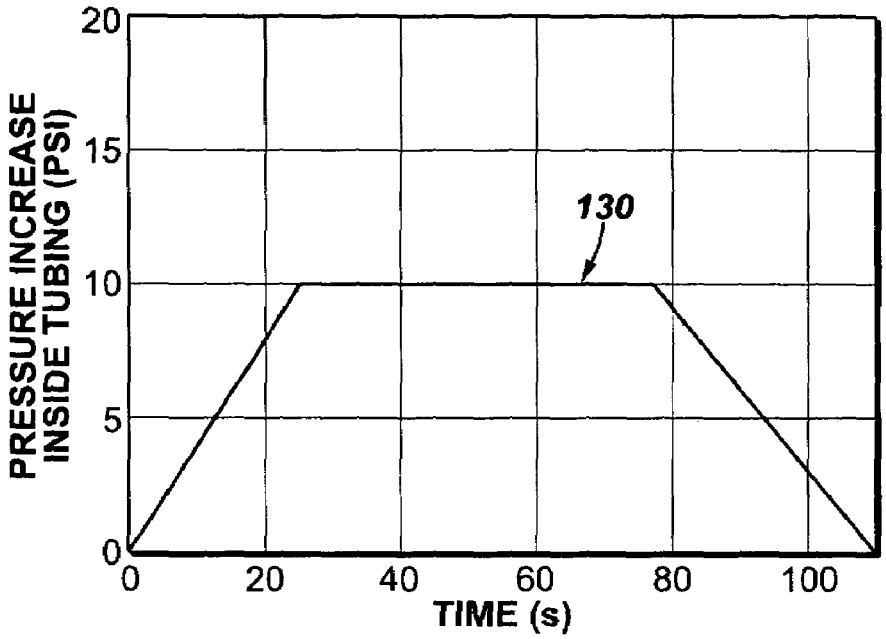
FIG. 7 depicts a pressure profile illustrating a pressure magnitude encoding technique to be applied to fluid inside a tubing string according to an embodiment of the invention.
Figure 8:
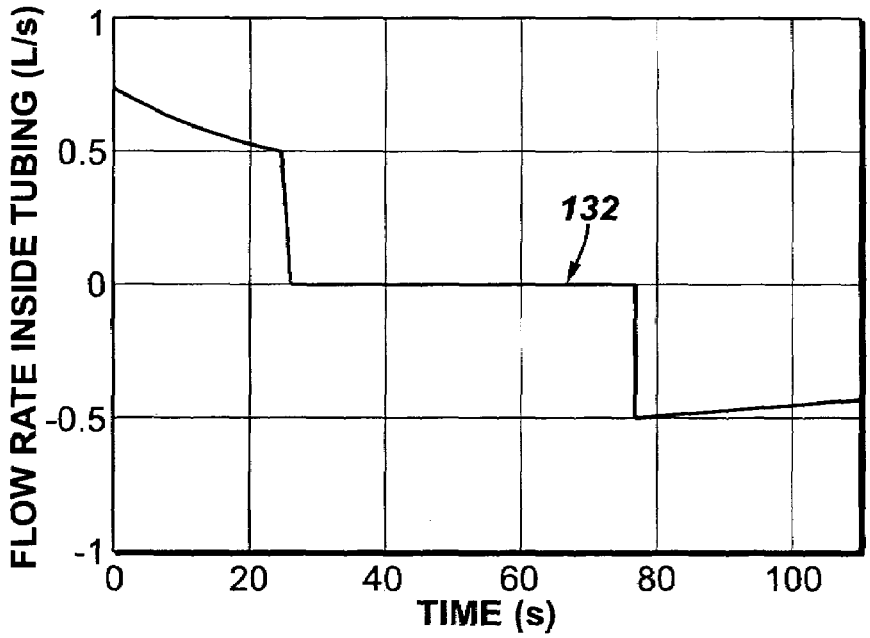
FIG. 8 depicts a liquid flow rate inside the tubing string in response to the pressure profile depicted in FIG. 7 according to an embodiment of the invention.
Figure 9:
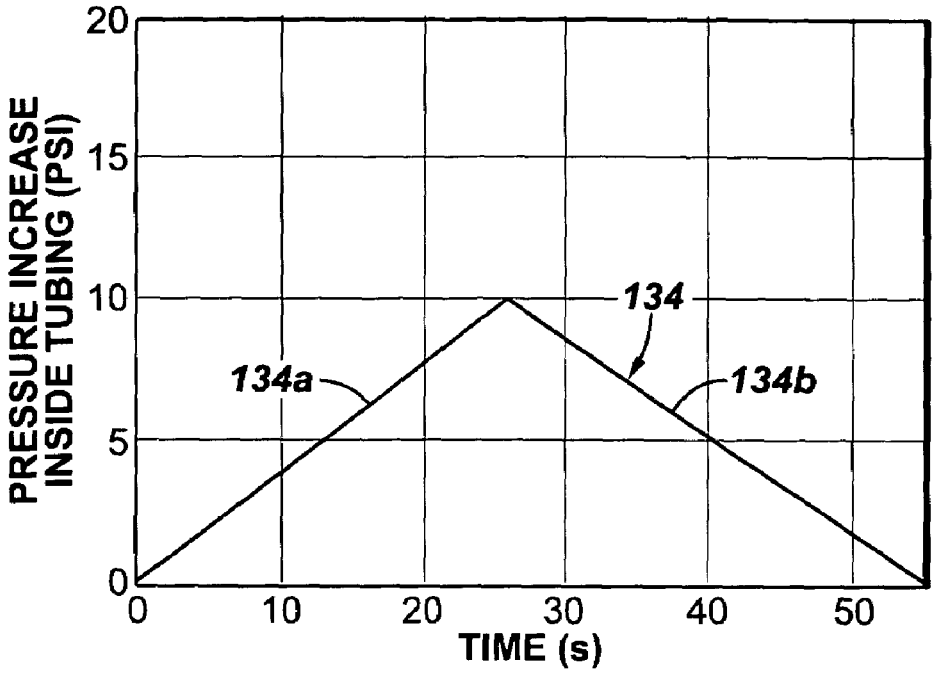
FIG. 9 depicts pressure profile illustrating a pressure gradient encoding technique to be applied to fluid inside the tubing string according to an embodiment of the invention.

FIGS. 7 and 9 depict exemplary pressure changes inside the tubing string 23 for the specific scenario in which the central passageway of the tubing string 23 has a 30 feet air column on top; and FIGS. 8 (for FIG. 7) and 10 (for FIG. 9) depict the corresponding liquid flow rates that result from these pressure changes.

More particularly, FIG. 7 depicts a tubing pressure waveform 130 that represents potential pressure level encoding, an encoding in which a certain pressure level represents one logical state of the bit, and another pressure level represents the other logical state. The waveform 130 represents an increase in pressure from ambient to 10 pounds per square inch (psi) by using a gas charging flow of 2.5 g/s (which is arbitrarily chosen, for purposes of this example). After this increase, the pressure is maintained at 10 psi for about 60 seconds and finally is bled down to atmospheric with a gas discharge rate of 2.5 $e^{-t/60}$ (g/s). The corresponding liquid flow rate is depicted in a waveform 132 that is depicted in FIG. 8. The liquid flow rate at the downhole sensor sub is basically the derivative of the corresponding pressure change. The liquid flow rate reaches a significant value as soon as the pressure starts rising, and the liquid flow rate drops to zero only when the pressure is constant and becomes a negative value when the pressure is bled.

From FIGS. 7 and 8, it can be seen that a signaling sequence based on binary pressure level changes needs a longer time to complete because the duration of a logic-state or a digit should be longer than the rising and falling time intervals. In contrast to the pressure waveform 130, FIG. 9 depicts a waveform 134 that illustrates a pressure gradient profile. Thus, a positive pressure gradient (depicted by the rising portion 134*a* of the waveform 134) may be used to encode one logical state (a "1," for example), and a negative pressure gradient (depicted by the falling portion 134*b* of the waveform 134) may be used to encode another logical state (a "0," for example).

Figure 10:
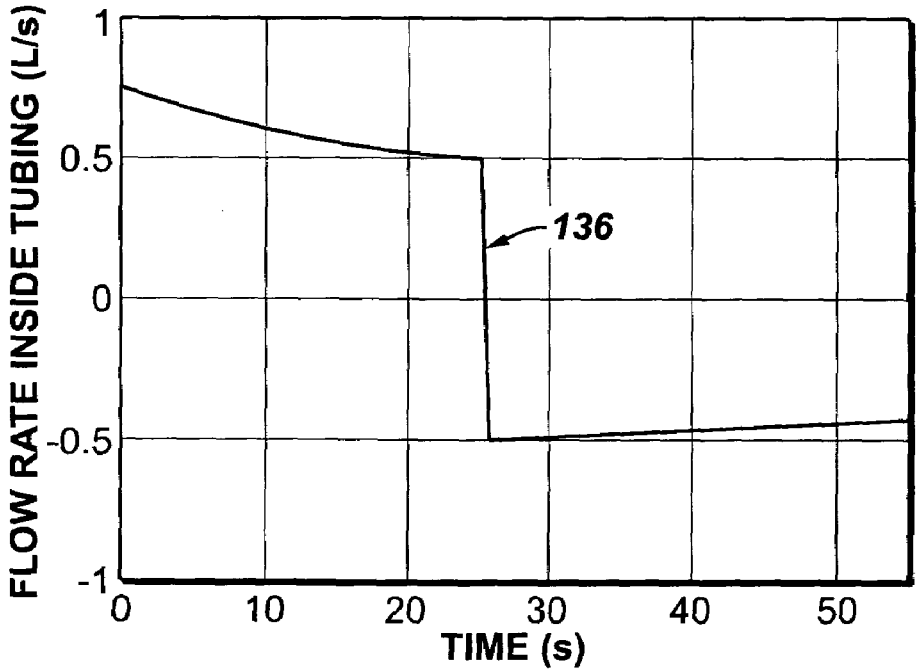
FIG. 10 depicts a liquid flow rate inside the tubing in response to the pressure profile depicted in FIG. 9 according to an embodiment of the invention.

As depicted in a resultant liquid flow rate waveform 136 shown in FIG. 10, a signal sequence based on binary flow levels can take much less time to implement. All that is needed is to generate the correct sequence of rising and falling pressure slopes. With a zero-DC encoded signal (e.g., Manchester code) and an appropriate initial pressure level, during the signaling, the absolute pressure level will vary within a small band above the atmospheric level and without the risk of over pressure.

The waveforms that are depicted in FIGS. 7-10 are simulated examples that are obtained under various assumptions (e.g. liquid not compressible, no acceleration and friction loss associated with liquid movement, annulus open to atmospheric pressure, 30 ft air column in the tubing, 2.5 g/s gas flow rate, etc.). The waveforms may thus vary if the situations are different. The flow method is particularly suitable for wells that are not filled fully with liquid and when the gas supply is sufficient. If the well and the tubing string are fully filled with liquid and the annulus valve on the surface is closed, then flow detection will be unsuitable because the liquid, although pressurized, has no space in which to move. In this case, pressure detection becomes necessary and binary pressure level sequences with short digit time can be generated because without gas in the tubing, the rising and falling time intervals of the pressure change can be dramatically reduced. The pressure method, without zero-DC encoding, will also be suitable when the gas supply is insufficient.

Therefore, for a general-purpose system, both flow rate and pressure detection mechanisms may be incorporated downhole, in some embodiments of the invention. As further described below, a diversity receiver may be used to select which mechanism is used to provide the decoded outputs according to the decode output's quality.

Figure 11:
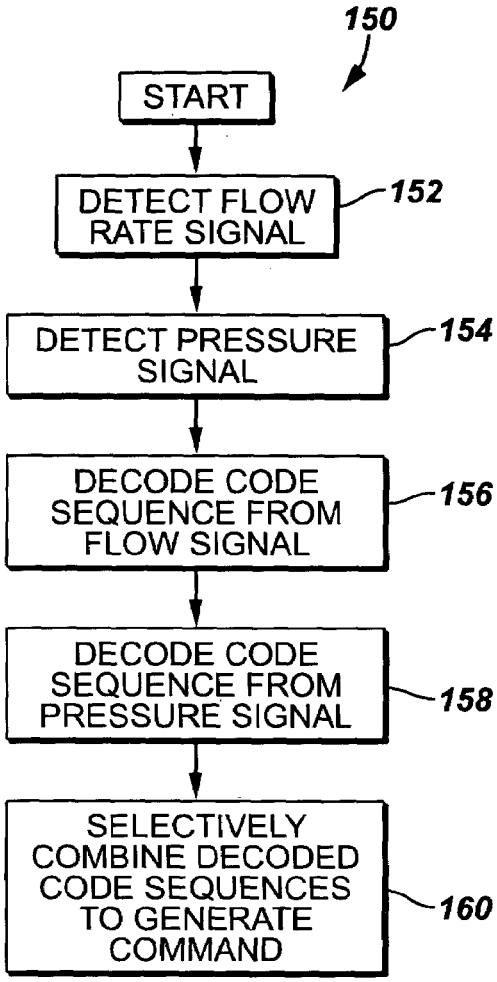
FIG. 11 is a flow diagram depicting a technique to decode a command from pressure and flow signals that are received downhole according to an embodiment of the invention.

More particularly, referring to FIG. 11, in some embodiments of the invention, a technique 150 may be used for purposes of detecting a command-encoded stimulus downhole and decoding a command therefrom. Pursuant to the technique 150, both flow rate (block 152) and pressure (block 154) signals are detected downhole. As discussed above, the flow and pressure signals that indicate a particular command are attributed to the specific application of a pressure level or pressure gradient encoding at the surface of the well. Pursuant to the technique 150, code sequences (each potentially indicative of the command) are decoded from the flow rate and pressure signals, as indicated in respective block 156 and 158. Then, the decoded code sequences are selectively combined (block 160) to derive the encoded command.

It is noted that the technique that is depicted in FIG. 11 does not necessarily mean that a flow signal and a pressure signal are communicated downhole during each operation. Rather, in some embodiments of the invention, only a command-encoded pressure signal or a command-encoded flow signal is communicated downhole, with the downlink module 40 having the capability of detecting the command from the appropriate signal.

Referring back to FIG. 3, in some embodiments of the invention, the liquid flow rate and pressure may be measured downhole by the downlink module 40 in the following manner. The downlink module 40 includes pressure sensors 50, 52 and 54: the pressure sensor 50 is located on a restricted flow section (described further below) of the downlink module 40; and the pressure sensors 52 and 54 are located on straight (i.e., non-restricted) flow section of the downlink module 40, which in the example depicted in FIG. 3 is below the restricted flow section. Electronics 42 (of the downlink module 40) may, for example, use the pressure sensors 52 and 50 to measure a pressure difference between the pressure sensors 52 and 50 (i.e., between the restricted and straight sections) to detect a downlink flow signal. The electronics 42 may detect a downlink pressure signal by using either pressure sensor 52 or 54, in some embodiments of the invention. The electronics 42 decodes the pressure/flow signal to extract a command, in some embodiments of the invention. Preferably, the pressure sampling by the sensor 52, 54 is on a cross-section more or less equal to the general inner cross-section of the tubing string 23 that extends to the surface of the well. Furthermore, for purposes of measuring pressure, the pressure sampling point should avoid narrow flow restrictions where flow-induced pressure drop may affect the measurement.

For purposes of detecting the flow signal and decoding a command therefrom, the downlink module 40 includes an intrinsic or purposely-designed flow restriction. For example, as depicted in FIG. 3, in some embodiments of the invention, the downlink module 40 includes a flow meter that is formed in part from a Venturi restriction 44. The Venturi restriction 44 is located inside the central passageway of the tubing string 23 to restrict the flow through the string 23. Alternatively, an orifice plate may be used in place of the Venturi restriction 44, in some embodiments of the invention. However, the Venturi restriction 44 generates less permanent pressure loss and may be advantageous for monitoring production flow or if the application involves through-tubing pumping services.

Referring to the more specific details of the Venturi restriction 44, in some embodiments of the invention, the pressure sensor 50 is placed at the throat of the Venturi restriction 44. Furthermore, as depicted in FIG. 3, in some embodiments of the invention, the pressure sensor 52 may be located further downhole to measure the pressure at the downhole side of the Venturi restriction 44. Thus, for downlink signal detection, the above-described arrangement is a Venturi flow meter with the flow in the reversed direction. Even so, the pressure difference between the pressure (called "$p_{s2}$") sensed by the sensor 52 and the pressure (called "$p_{s1}$") sensed by the pressure sensor 50 is a function of the volumetric flow rate, $q_L$, may be described as follows:

$$q_L = C_r\sqrt{\frac{p_{s2} - p_{s1}}{\rho}}, \qquad \text{Equation 10}$$

where "$C_r$" represents a coefficient mainly related to the reversed meter configuration and the Venturi contraction ratio and "ρ" represents the fluid density at the throat. Therefore, the pressure sensors 50 and 52 in addition to the Venturi flow restriction 44 provide a downhole flow meter that is used for purposes of detecting a command that is communicated from the surface of the well. It is noted that this flow meter may not have to be very accurate for binary signal detection.

In some embodiments of the invention, the downlink module 40 may be used for purposes of measuring a downhole characteristic of the well and relaying this measurement to the uplink module 24 so that the uplink module may communicate the measurement uphole. More specifically, in some embodiments of the invention, the electronics 42 of the downlink module 40 may use the above-described flow meter to 1.) detect a command that is communicated downhole; and 2.) sense a downhole parameter, such as a production flow (as an example), in accordance with the techniques 1 (FIG. 1) and 6 (FIG. 2). Therefore, the flow meter is used to decode commands as well as is used a permanent sensing device.

Thus, the Venturi restriction 44 may be used for production flow monitoring after installation of the completion. Since the production flow is from downhole to surface, the Venturi flow meter is in the right orientation. The flow rate is linked to the differential pressure measurement by the following equation:

$$q_L = C_p\sqrt{\frac{p_{s2} - p_{s1}}{\rho}}, \qquad \text{Equation 11}$$

The difference between Eqs. 10 and 11 is between the coefficients, $C_r$ and $C_p$. The density of the production fluid, ρ, may be measured with a differential pressure measurement between two pressure sensors mounted on a straight section of the tubing, e.g. sensor 52 and 54 (FIG. 3), according to the following relationship:

$$p_{s2} - p_{s3} = \rho g h_{23}, \qquad \text{Equation 12}$$

where "ρ" represents the fluid density, "g" represents the gravitational acceleration and "$h_{23}$" represents the vertical separation between the pressure sensors 52 and 54. In the case of a multi-phase flow the density measured according to Eq. 12 provides information about water-holdup, or gas liquid ratio. Other embodiments for determining the fluid density of the fluid exist, but an accurate determination of the fluid density is not required for the downlink telemetry using fluid flow as the measurement for the receiver.

Figure 12:
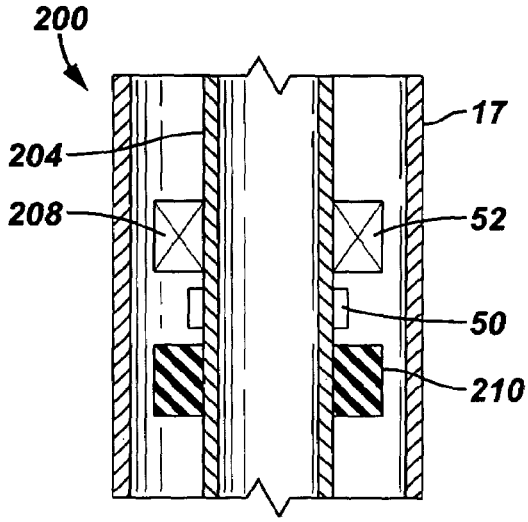
FIGS. 12 and 13 depict mechanisms to measure a flow rate downhole according to different embodiments of the invention.

Referring to FIG. 12, in some embodiments of the invention, the above-described Venturi-based downhole flow rate detector may be replaced by a non-Venturi-based downhole flow rate detector 200. In the flow rate detector 200, the Venturi restriction is replaced by an annular flow restriction 208 (on the outside of a tubing 204) that may be mounted, for example, above a packer body 210. The tubing 204, in turn, may be mounted in line with the tubing string 23 (see FIG. 3). In this configuration, the pressure sensor 50 is mounted on the outside of the tubing 204. Alternatively, the pressure sensor 50 may be placed on the inside of the tubing 204. The pressure sensor 52 measures the pressure in an annulus restriction that is created by restrictions 208 and 210.

Figure 13:
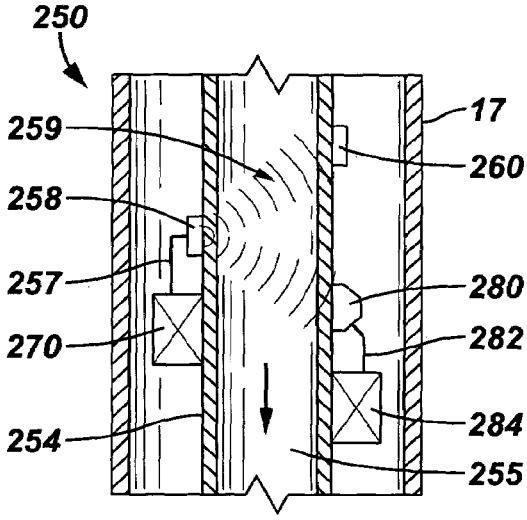

As another example of a downhole flow meter, FIG. 13 depicts a downhole flow rate detector 250 that includes a tubing 254 (concentric with the tubing string 23 (see FIG. 3)) that includes an ultrasonic transceiver 258 that transmits an ultrasonic pulse 259 into a flow 255 of fluid that flows through the tubing 254. As soon as a transceiver 260 (located on the tubing string 23 across from the transceiver 258) detects the arrival of the ultrasonic pulse 259, the transceiver 260 generates an electric signal that triggers the transducer 258 to send the ultrasonic pulse again. Therefore, the frequency of the pulses that appears at the transceiver 260 may be recorded as a frequency called "$f_1$." After a predetermined number of cycles, the transceiver 260 begins sending pulses to the transducer 258 in a similar arrangement, and the frequency of pulses received by the transceiver 258 is recorded as a frequency called "$f_2$." The two frequencies are different because the $f_1$ is affected by the propagation of the ultrasound with the production flow; and the $f_2$ frequency is affected by propagation against the flow. Therefore, the $f_1$ frequency is greater than the $f_2$ frequency. From this frequency difference, electronics 270 (connected to the transducers via a cable 257) determines the flow velocity, as described below:

$$f_1 - f_2 = \frac{2V\cos\theta}{L}, \qquad \text{Equation 13}$$

where "V" represents the flow velocity; "L" represents the path length of the ultrasound in the flow; and "θ" represents the angle between the flow direction and the ultrasonic path.

A Doppler flow meter may also be used if the fluid under measurement is not clean and thus, the fluid contains reflectors. This example is also depicted in FIG. 13 that uses a single Doppler probe 280. A sinusoidal ultrasound wave is transmitted into the flow 255 by an ultrasonic transmitter, and reflected energy from flowing particles is analyzed by electronics 284 (connected to the Doppler probe 280 by a cable) to determine its Doppler frequency shift. The electronics 284 uses this determined shift to determine the flow velocity.

Among its other features, in some embodiments of the invention, the downlink module 40 (see FIG. 3) may be a general carrier for additional sensors for measuring various downhole parameters, e.g. formation resistivity, fluid viscosity, chemical composition of the fluid, scale deposit etc. One or more of the sensors may be used for purposes of detecting commands communicated downhole as well as serve as permanent sensing devices, in some embodiments of the invention.

Figure 14:
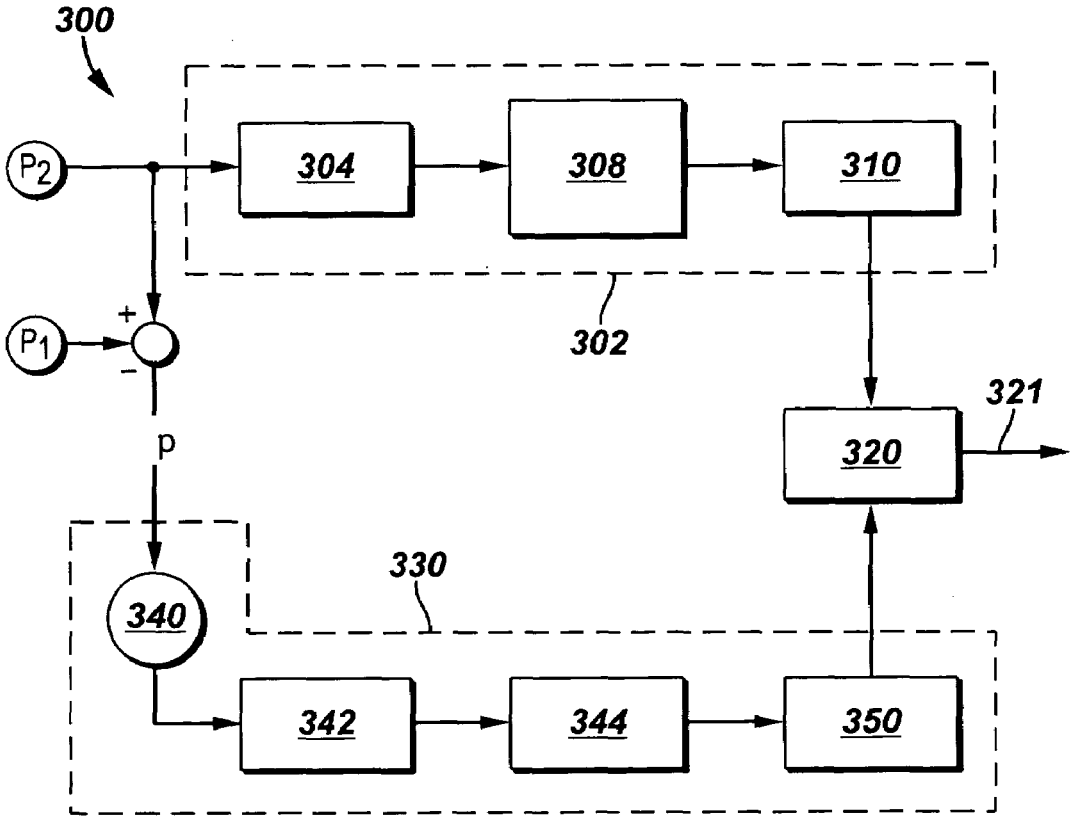
FIG. 14 is a block diagram of a downhole digital receiver according to an embodiment of the invention.

Referring to FIG. 3 in conjunction with FIG. 14, in some embodiments of the invention, the downlink module 40 may include a downhole digital receiver 300. The detector 300 is a diversity system that is based on post-detection combination. A pressure signal from the pressure sensor 52 is communicated to a pressure detector 302, where the low frequency drift and high frequency noise are first removed by a filter unit 304. A synchronizer 308 of the pressure detector 302 synchronizes the flow detector 302 to the incoming digital sequence.

In the case of zero-DC modulation, the synchronizer 308 first demodulates the incoming sequence and reproduces the original digital code. The synchronizer 308 then recognizes a precursor, such as the Barker code, and synchronizes the pressure detector 302 to the code. The resultant code from the synchronizer 308 is communicated to an equalizer and decision unit 320 that corrects linear distortions of the signal associated with the characteristics of the channel. The decision unit in the equalizer 310 selects ones and the zeros of the equalizer output.

A flow detector 330 of the receiver 300 has the same structure as the pressure detector 302 discussed above, apart from an additional differential pressure to flow converter 340. Thus, a flow signal is provided to a filter unit 342 that removes low frequency drift and high frequency noise. A synchronizer 344 then synchronizes the flow detector 330 to the incoming digital sequence, similar to the synchronizer 308. An equalizer and decision unit 350 selects the ones and zeros at the equalizer output.

A diversity combiner 320 of the receiver 300 combines data that is provided by both equalizer and decision units 310 and 350 and selects, according to the quality (a signal-to-noise ratio, for example) of each combination, a best combination at its output. The output command is then communicated to a tool actuator (not shown) for execution via the output terminals 321 of the combiner 320. Alternatively, the combiner 320 may average the outputs from the decision units 310 and 350, depending on the particular embodiment of the invention.

There are other methods of combining signals from multiple sensors in a receiver. For instance, rather than using an equalizer for each channel, the outputs from the synchronizers shown in FIG. 14 may be combined into a multi-channel equalizer to produce an optimized decision, in other embodiments of the invention.

Referring back to FIG. 3, after the downhole tools 60 execute the commands and perform the required operations including the setting of a packer, liquid, such as brine or water, may be pumped into the annulus 39 to fill it up, creating a channel for pressure wave communication. The details of the uplink telemetry are described in U.S. patent application Ser. No. 11/017,631, entitled, "BOREHOLE TELEMETRY SYSTEM," filed on Dec. 20, 2004, having Songming Huang, Franck Monmont, Robert Tennent, Matthew Hackworth and Craig Johnson as inventors. A pressure wave source on the surface of the well generates a harmonic pressure wave in the annulus. The wave propagates to a downhole packer (for example) and gets reflected back there towards the surface. Downhole measurement data and confirmation messages regarding the operation results of the downhole tools are coded by the uplink module 24 in binary form. The uplink module 24 then controls the resonator 30 (a Helmholtz resonator, for example) to change the reflectivity between two distinct levels at the downhole end of the channel, resulting in phase modulation of the reflected wave. Therefore the binary digital sequence is modulated onto the phase of the reflected wave that travels to the surface.

A pressure sensor 14 that is located at the surface of the well detects the reflected pressure wave, depicted by the pressure called "$p_s$" in FIG. 3. The resultant $p_s$ pressure signal may be demodulated, for example, by a digital receiver inside that is located inside the module 12.

Once the annulus channel is created, further downlink signals may be sent from the surface via this channel. Instructions in binary digital form may be used to modulate the frequency, phase or amplitude of the source signal on surface. An annulus pressure sensor or a hydrophone may be used as the detecting sensor downhole. The receiver for demodulating this signal is in many ways similar to that used in the surface receiver for the uplink telemetry, although with modifications to facilitate frequency or amplitude demodulation.

This annulus channel also facilitates a wireless and battery-less permanent well monitoring system, as described in U.S. patent application Ser. No. 11/017,631 entitled, "BOREHOLE TELEMETRY SYSTEM," filed on Dec. 20, 2004, having Songming Huang, Franck Monmont, Robert Tennent, Matthew Hackworth and Craig Johnson as inventors. By installing a mechanical to electrical energy converter, such as a device based on piezoelectric, magnetostrictive or electrostrictive materials, electrical energy can be generated downhole by sending pressure wave energy from the surface. This enables the downhole sensor and telemetry subs to be powered up whenever measurements are needed.

A change in state of the downhole tool 60 may also be accomplished via the system 10, that is depicted in FIG. 3. For example, if the tool 60 is a packer, the system 10 may be used to detect whether the packer has been set. More particularly, the technique may be applicable where the tubing string 23 is not completely filled by liquid. After the downlink signaling, the tubing head is charged again by gas that has the same mass flow rate as that used in the signaling. The slope of a pressure increase at the tubing/well head is measured and compared with that of the signaling period when the packer was not set. The slope should become much steeper if the packer 60 has been set because the liquid column will not move after pressure is applied. This should confirm that the packer setting command has been executed.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

using at least one downhole sensor to establish telemetry within the well;

using said at least one sensor as a permanent sensing device to measure a characteristic of the well other than a characteristic associated with the telemetry; and using the telemetry established by the sensor to decode a command communicated downhole, the command targeting a downhole tool other than said at least one downhole sensor.

2. The method of claim 1, wherein said at least one sensor comprises a flow meter.

3. The method of claim 2, wherein the flow meter decodes the command communicated from the service of the well and monitors a production flow downhole.

4. The method of claim 1, further comprising:

communicating with said at least one sensor from the surface of the well to communicate the command downhole for a downhole tool; and in response to the tool acting upon the command, creating a fluid column in the well for communication of a stimuli uphole indicative of a measurement taken by said at least one sensor.

5. The method of claim 4, wherein said at least one sensor comprises a flow meter.

6. A system usable with a well, comprising:

at least one sensor adapted to establish telemetry within the well and measure a characteristic of the well other than a characteristic associated with telemetry;

a downlink circuit coupled to said at least one sensor to use said at least one sensor to receive a command communicated downhole, the command targeting a tool other than said at least one sensor; and an uplink circuit coupled to said at least one sensor to communicate a well condition sensed by the sensor uphole.

7. The system of claim 6, further comprising:

the tool, wherein the tool is adapted to act on the command.

8. The system of claim 6, wherein said at least one sensor comprises a flow meter.

9. The system of claim 8, wherein the flow meter decodes a command communicated from the service of the well and monitors a production flow dowuhole.

10. The system of claim 8, wherein the flow meter comprises at least one of an orifice restriction through which a downhole fluid flows, a Venturi restriction through which the downhole fluid flows and a Doppler flow meter.

11. The method of claim 8, wherein the flow meter comprises at least one pressure sensor.

12. A method usable with a well, comprising:

encoding a first code sequence with a synchronization code to produce a second code sequence; and generating a stimulus in fluid of the well to communicate the second code sequence downhole, comprising:

adjusting a pressure of the fluid at the surface of the well;

measuring the pressure; and repeating the acts of adjusting and measuring in a feedback loop to establish predetermined pressure profiles for logical bit states.

13. The method of claim 12, wherein the first code sequence indicates a command for a downhole tool.

14. The method of claim 12, further comprising:

encoding the first code sequence with an error correction code.

15. The method of claim 12, wherein the act of generating the stimulus comprises adjusting a pressure magnitude of the fluid to indicate each bit of the second code sequence.

16. The method of claim 12, wherein the act of generating comprises changing a gradient of pressure of the fluid to indicate each bit of the second code sequence.

17. A method usable with a well, comprising:

receiving a code sequence indicative of information to be communicated downhole;

modulating the code sequence to remove a portion of spectral energy of the code sequence located near zero frequency to create a signal; and generating a stimulus in fluid of the well to communicate the signal downhole.

18. The method of claim 17, wherein the information comprises a command for a downhole tool.

19. The method of claim 17, further comprising:

adding an error correction code to the received code sequence prior to the modulation.

20. The method of claim 17, wherein the act of generating the stimulus comprises for each bit of the signal, controlling a pressure magnitude of the fluid to indicate a logical state of the bit.

21. The method of claim 17, wherein the signal comprises bits and the act of generating the stimulus comprises for each bit of the signal, adjusting a pressure gradient of the fluid to indicate a logical state of the bit.

22. The method of claim 17, wherein the signal comprises bits and the act of generating the stimulus comprises:

measuring a pressure of the fluid at the surface of the well;

applying pressure to the fluid at the surface of the well; and repeating the acts of adjusting and measuring in a feedback loop to establish predetermined pressure profiles for logical bit states.

23. A method usable with a well, comprising:

decoding a flow signal downbole to generate a first code sequence;

decoding a pressure signal downhole to generate a second code sequence; and selectively combining the first code sequence and the second code sequence to generate a third code sequence indicative of information communicated downhole.

24. The method of claim 23, wherein the information comprises a command for a downhole tool.

25. The method of claim 23, wherein the act of selectively combining comprises selectively combining bits from the first code sequence and the second code sequence on a bit-by-bit basis.

26. The method of claim 23, wherein the act of selectively combining comprises selecting, for each bit of the third code sequence, either a bit from the first code sequence or a bit from the second code sequence.

27. The method of claim 23, wherein the act of selectively combining comprises averaging the first code sequence and the second code sequence.

28. The method of claim 23, wherein the act of decoding the flow signal comprises measuring pressures associated with a Venturi flow downhole.

29. The method of claim 23, wherein the act of decoding the flow signal downhole comprises at least one of communicating an ultrasonic wave through a downhole fluid, flowing the downhole fluid through a Venturi restriction and flowing the dowuhole fluid.

30. A system usable with a well, comprising:

an uplink modulator located dowuhole in the well to modulate a carrier stimulus to generate a second stimulus transmitted uphole indicative of a downhole measurement; and a downlink module adapted to decode a flow signal communicated from the surface of the well and a pressure signal communicated from the surface of the well and selectively combine the decoded flow and pressure signals to provide a command for a downbole tool.

31. The system of claim 30, wherein the downlink module comprises a Venturi flow device comprising sensors to detect flow of fluid dowuhole to decode the flow signal.

32. The system of claim 30, wherein the downlink module comprises an ultrasonic transmitter to transmit an ultrasonic wave into downhole fluid and at least one sensor to use the ultrasonic wave to detect the flow signal.

33. The system of claim 30, further comprising:

a downhole tool actuated by the command provided by the dowulink module.

34. The system of claim 30, further comprising:

a pressure generator to adjust the pressure of fluid at the surface of the well to communicate a command dowuhole;

a sensor to measure the pressure; and a controller to repeat the measurement and the adjustment of the pressure in a feedback loop to establish predetermined pressure profiles for logical bit states.

35. A system usable with a well, comprising:

an encoder to encode a first code sequence with a synchronization code to generate an encoded code sequence;

a stimulus generator to generate a stimulus in fluid of the well to communicate the encoded code sequence downhole; and a sensor located at the surface of the well to measure a pressure of the fluid, wherein the stimulus generator uses the measurement in a feedback loop to regulate the pressure.

36. The system of claim 35, wherein the first code sequence indicates a command for a downhole tool.

37. The system of claim 35, wherein the encoder is further adapted to encode the first code sequence with an error correction code.

38. The system of claim 35, wherein the encoded command sequence comprises bits and the stimulus generator is adapted to, for each bit of the encoded command sequence, adjust a pressure magnitude of the fluid to indicate a logical level of the bit.

39. The system of claim 35, wherein the encoded command sequence comprises bits and the stimulus generator is adapted to, for each bit of the encoded command sequence, cause a pressure gradient of the fluid to indicate a logical level of the bit.

40. A system usable with a well, comprising:

a modulator to receive a code sequence indicative of information to be communicated downhole and modulate the code sequence to remove a portion of spectral energy of the code sequence located near zero frequency to create a signal; and stimulus generator to generate a stimulus in fluid of the well to communicate the modulated code sequence downhole.

41. The system of claim 40, wherein the code sequence comprises error correction code.

42. The system of claim 40, wherein the information comprises a command.

43. The system of claim 40, wherein the encoded command sequence comprises bits and the stimulus generator is adapted to, for each bit of the modulated code sequence, adjust a pressure magnitude of the fluid to indicate a logical level of the bit.

44. The system of claim 40, wherein the encoded command sequence comprises bits and the stimulus generator is adapted to, for each bit of the modulated encoded signal, generate a pressure gradient in the fluid to indicate a logical state of the bit.

45. The system of claim 40, further comprising:

a sensor adapted to measure a pressure of the fluid, wherein the stimulus generator is adapted to use the measurement to generate the stimulus in a feedback loop to establish predetermined pressure profiles for logical bit states.

46. The system of claim 40, wherein the code sequence comprises synchronization code.

47. A downhole receiver usable with a well, comprising:

a flaw signal detector adapted to decode a flow signal downhole to generate a first code sequence;

a pressure signal detector adapted to decode a pressure signal downhole to generate a second code sequence; and a combiner to selectively combine the first code sequence and the second code sequence to generate a third code sequence indicative of information communicated from a surface of the well.

48. The downhole receiver of claim 47, wherein the information comprises a command.

49. The downhole receiver of claim 47, wherein each of the first, second and third code sequences comprises bits, and the combiner, for each bit of the third code sequence, chooses between a bit of the first code sequence and a bit of the second code sequence.

50. The downhole receiver of claim 47, wherein each of the first, second and third code sequences comprises bits, and the combiner, for each bit of the third code sequence, selects between a bit of the first code sequence and a bit of the second code sequence.

51. The downhole receiver of claim 47, wherein the combiner is adapted to average the first code sequence and the second code sequence to generate the third code sequence.

* * * * *